US007641963B2

(12) United States Patent
Grafenauer

(10) Patent No.: US 7,641,963 B2
(45) Date of Patent: Jan. 5, 2010

(54) PANEL AND PROCESS FOR PRODUCING A PANEL

(75) Inventor: Thomas Grafenauer, Onzour sur Loire (FR)

(73) Assignee: Kronotec AG, Luzern (CH)

( * ) Notice: Subject to any disclaimer, the term of this patent is extended or adjusted under 35 U.S.C. 154(b) by 1162 days.

(21) Appl. No.: 10/697,560

(22) Filed: Oct. 31, 2003

(65) Prior Publication Data

US 2004/0126550 A1 Jul. 1, 2004

(30) Foreign Application Priority Data

Nov. 12, 2002 (DE) ..... 102 52 866

(51) Int. Cl.
*B32B 7/02* (2006.01)

(52) U.S. Cl. ..... 428/212; 428/174; 52/220.1; 52/223.6; 52/592.1; 52/390; 52/782.1; 52/796.1

(58) Field of Classification Search ..... 428/212, 428/174; 52/220.1, 223.6, 592.1, 390, 782.1, 52/796.1

See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |

(Continued)

FOREIGN PATENT DOCUMENTS

| | | |
|---|---|---|
| AT | 57133 | 3/1988 |

(Continued)

OTHER PUBLICATIONS

Webster Dictionary, p. 862.

(Continued)

*Primary Examiner*—David R Sample
*Assistant Examiner*—Lawrence D Ferguson
(74) *Attorney, Agent, or Firm*—Greenblum & Bernstein P.L.C.

(57) ABSTRACT

A panel, in particular floor panel, having a support board made of glued and compressed fiber material to which a termination layer is applied in each case on a top side and an underside, and the termination layer of the top side has a structured surface, and to a process for producing such a panel or such a support board. The object of the invention is to provide a panel or a support board comprising binders and fillers and also a process for producing the same, by means of which surface-structured panels can be produced more quickly and cost-effectively. This object is achieved in that the density on the top side of the support board is lower than the density of the support board on the underside.

21 Claims, 1 Drawing Sheet

U.S. PATENT DOCUMENTS

| | | | |
|---|---|---|---|
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Mitte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Ridder |
| 3,203,149 | A | 8/1965 | Soddy |
| 3,204,380 | A | 9/1965 | Smith et al. |
| 3,267,630 | A | 8/1966 | Omholt |
| 3,282,010 | A | 11/1966 | King, Jr. |
| 3,310,919 | A | 3/1967 | Bue et al. |
| 3,347,048 | A | 10/1967 | Brown et al. |
| 3,460,304 | A | 8/1969 | Braeuninger et al. |
| 3,481,810 | A | 12/1969 | Waite |
| 3,526,420 | A | 9/1970 | Brancaleone |
| 3,538,665 | A | 11/1970 | Gohner |
| 3,553,919 | A | 1/1971 | Omholt |
| 3,555,762 | A | 1/1971 | Costanzo, Jr. |
| 3,608,258 | A | 9/1971 | Spratt |
| 3,639,200 | A | 2/1972 | Elemendorf et al. |
| 3,694,983 | A | 10/1972 | Couquet |
| 3,714,747 | A | 2/1973 | Curran |
| 3,720,027 | A | 3/1973 | Christensen |
| 3,731,445 | A | 5/1973 | Hoffmann et al. |
| 3,759,007 | A | 9/1973 | Thiele |
| 3,760,548 | A | 9/1973 | Sauer et al. |
| 3,768,846 | A | 10/1973 | Hensley et al. |
| 3,859,000 | A | 1/1975 | Webster |
| 3,878,030 | A | 4/1975 | Cook |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,006,048 | A | 2/1977 | Cannady, Jr. et al. |
| 4,090,338 | A | 5/1978 | Bourgade |
| 4,091,136 | A | 5/1978 | O'Brian et al. |
| 4,099,358 | A | 7/1978 | Compaan |
| 4,118,533 | A | 10/1978 | Hipchen et al. |
| 4,131,705 | A | 12/1978 | Kubinsky |
| 4,164,832 | A | 8/1979 | Van Zandt |
| 4,169,688 | A | 10/1979 | Toshio |
| 4,175,105 | A | 11/1979 | Luck et al. |
| 4,175,148 | A | 11/1979 | Luck et al. |
| 4,175,149 | A | 11/1979 | Luck et al. |
| 4,175,150 | A | 11/1979 | Luck et al. |
| 4,242,390 | A | 12/1980 | Nemeth |
| 4,243,716 | A | 1/1981 | Kosaka et al. |
| 4,245,689 | A | 1/1981 | Grard et al. |
| 4,246,310 | A | 1/1981 | Hunt et al. |
| 4,283,450 | A | 8/1981 | Luck et al. |
| 4,290,248 | A | 9/1981 | Kemerer et al. |
| 4,299,070 | A | 11/1981 | Oltmanns et al. |
| 4,426,820 | A | 1/1984 | Terbrack et al. |
| 4,431,044 | A | 2/1984 | Bruneau |
| 4,471,012 | A | 9/1984 | Maxwell |
| 4,501,102 | A | 2/1985 | Knowles |
| 4,561,233 | A | 12/1985 | Harter et al. |
| 4,585,685 | A | 4/1986 | Forry et al. |
| 4,612,745 | A | 9/1986 | Hovde |
| 4,641,469 | A | 2/1987 | Wood |
| 4,653,242 | A | 3/1987 | Ezard |
| 4,654,244 | A | 3/1987 | Eckert et al. |
| 4,703,597 | A | 11/1987 | Eggemar |
| 4,715,162 | A | 12/1987 | Brightwell |
| 4,738,071 | A | 4/1988 | Ezard |
| 4,752,497 | A | 6/1988 | McConkey et al. |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,905,442 | A | 3/1990 | Daniels |
| 4,947,602 | A | 8/1990 | Pollasky |
| 5,029,425 | A | 7/1991 | Bogataj |
| 5,103,614 | A | 4/1992 | Kawaguchi et al. |
| 5,113,632 | A | 5/1992 | Hanson |
| 5,117,603 | A | 6/1992 | Weintraub |
| 5,136,823 | A | 8/1992 | Pellegrino |
| 5,145,732 | A * | 9/1992 | Kyutoku et al. ..... 428/36.1 |
| 5,165,816 | A | 11/1992 | Parasin |
| 5,179,812 | A | 1/1993 | Itill |
| 5,205,091 | A | 4/1993 | Brown |
| 5,216,861 | A | 6/1993 | Meyerson |
| 5,251,996 | A | 10/1993 | Hiller et al. |
| 5,253,464 | A | 10/1993 | Nilsen |
| 5,283,102 | A | 2/1994 | Sweet et al. |
| 5,295,341 | A | 3/1994 | Kajiwara |
| 5,335,473 | A | 8/1994 | Chase |
| 5,348,778 | A | 9/1994 | Knipp et al. |
| 5,349,796 | A | 9/1994 | Meyerson |
| 5,390,457 | A | 2/1995 | Sjölander |
| 5,413,834 | A | 5/1995 | Hunter et al. |
| 5,433,806 | A | 7/1995 | Pasquali et al. |
| 5,474,831 | A | 12/1995 | Nystrom |
| 5,497,589 | A | 3/1996 | Porter |
| 5,502,939 | A | 4/1996 | Zadok et al. |
| 5,506,026 | A | 4/1996 | Iwata et al. |
| 5,540,025 | A | 7/1996 | Takehara et al. |
| 5,567,497 | A | 10/1996 | Zegler et al. |
| 5,570,554 | A | 11/1996 | Searer |
| 5,591,289 | A | 1/1997 | Souders et al. |
| 5,597,024 | A | 1/1997 | Bolyard et al. |
| 5,630,304 | A | 5/1997 | Austin |
| 5,653,099 | A | 8/1997 | MacKenzie |
| 5,671,575 | A | 9/1997 | Wu |
| 5,694,734 | A | 12/1997 | Cercone et al. |
| 5,706,621 | A | 1/1998 | Pervan |
| 5,736,218 | A | 4/1998 | Iwata et al. |
| 5,736,227 | A | 4/1998 | Sweet et al. |

5,768,850 A 6/1998 Chen
5,797,175 A 8/1998 Schneider
5,797,237 A 8/1998 Finkell, Jr.
5,823,240 A 10/1998 Bolyard et al.
5,827,592 A 10/1998 Van Gulik et al.
5,855,832 A * 1/1999 Clausi ..... 264/109
5,860,267 A 1/1999 Pervan
5,935,668 A 8/1999 Smith
5,943,239 A 8/1999 Shamblin et al.
5,953,878 A 9/1999 Johnson
5,968,625 A 10/1999 Hudson
5,985,397 A 11/1999 Witt et al.
5,987,839 A 11/1999 Hamar et al.
6,006,486 A * 12/1999 Moriau et al. ..... 52/589.1
6,023,907 A 2/2000 Pervan
6,065,262 A 5/2000 Motta
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,324,803 B1 12/2001 Pervan
6,345,481 B1 2/2002 Nelson
6,352,661 B1 * 3/2002 Thompson et al. ..... 264/109
6,363,677 B1 4/2002 Chen et al.
6,397,547 B1 6/2002 Martensson
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 * 9/2002 Nelson ..... 52/582.1
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålsson et al.
6,546,691 B2 4/2003 Peopolder
6,553,724 B1 4/2003 Bigler
6,558,754 B1 5/2003 Velin et al.
6,565,919 B1 5/2003 Hansson et al.
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 * 9/2003 Chen et al. ..... 428/195.1
6,635,174 B1 10/2003 Berg et al.
6,641,629 B2 11/2003 Safta et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,675,545 B2 1/2004 Chen et al.
6,681,820 B2 1/2004 Olofsson
6,682,254 B1 1/2004 Olofsson et al.
6,685,993 B1 2/2004 Hansson et al.
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,841,023 B2 1/2005 Mott
2001/0029720 A1 10/2001 Pervan
2001/0034992 A1 11/2001 Pletzer et al.
2002/0007608 A1 1/2002 Pervan
2002/0007609 A1 1/2002 Pervan
2002/0014047 A1 2/2002 Thiers
2002/0020127 A1 2/2002 Thiers et al.
2002/0046528 A1 4/2002 Pervan et al.
2002/0056245 A1 5/2002 Thiers
2002/0106439 A1 8/2002 Cappelle
2002/0160680 A1 10/2002 Laurence et al.
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0115812 A1 6/2003 Pervan
2003/0115821 A1 6/2003 Pervan
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0016196 A1 1/2004 Pervan
2004/0035078 A1 2/2004 Pervan
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0200165 A1 10/2004 Garcia et al.
2004/0206036 A1 10/2004 Pervan
2004/0237447 A1 12/2004 Thiers et al.
2004/0237448 A1 12/2004 Thiers et al.
2004/0241374 A1 12/2004 Thiers et al.
2004/0244322 A1 12/2004 Thiers et al.
2004/0250493 A1 12/2004 Thiers et al.
2004/0255541 A1 12/2004 Thiers et al.

| | | | |
|---|---|---|---|
| 2004/0258907 | A1 | 12/2004 | Kornfalt et al. |
| 2005/0003149 | A1 | 1/2005 | Kornfalt et al. |
| 2005/0016099 | A1 | 1/2005 | Thiers |

FOREIGN PATENT DOCUMENTS

| | | | |
|---|---|---|---|
| AT | 005566 | | 8/2002 |
| AU | 713628 | | 5/1998 |
| AU | 200020703 | | 1/2000 |
| BE | 417526 | | 9/1936 |
| BE | 557844 | | 6/1957 |
| BE | 557844 | | 3/1960 |
| BE | 09600527 | | 6/1998 |
| BE | 09700344 | | 10/1998 |
| CA | 991373 | | 6/1976 |
| CA | 2226286 | | 12/1997 |
| CA | 2252791 | | 5/1999 |
| CA | 2289309 | | 7/2000 |
| CH | 200949 | | 1/1939 |
| CH | 211877 | | 1/1941 |
| CH | 562377 | | 5/1975 |
| DE | 314207 | | 9/1919 |
| DE | 531989 | | 8/1931 |
| DE | 740235 | | 10/1943 |
| DE | 1089966 | | 9/1960 |
| DE | 1534278 | | 2/1966 |
| DE | 1212225 | | 3/1966 |
| DE | 1212275 | | 3/1966 |
| DE | 1534802 | | 4/1970 |
| DE | 7102476 | | 6/1971 |
| DE | 2007129 | | 9/1971 |
| DE | 1534278 | | 11/1971 |
| DE | 2252643 | | 10/1972 |
| DE | 2238660 | | 2/1974 |
| DE | 7402354 | | 5/1974 |
| DE | 2502992 | | 7/1976 |
| DE | 2616077 | | 10/1977 |
| DE | 2917025 | | 11/1980 |
| DE | 7911924 | | 3/1981 |
| DE | 7928703 | | 5/1981 |
| DE | 3041781 | | 6/1982 |
| DE | 3214207 | | 11/1982 |
| DE | 8226153 | | 1/1983 |
| DE | 3343601 | | 6/1985 |
| DE | 86040049 | | 6/1986 |
| DE | 3512204 | | 10/1986 |
| DE | 3246376 | | 2/1987 |
| DE | 4004891 | | 9/1990 |
| DE | 4030586 | A1 | 4/1991 |
| DE | 4002547 | | 8/1991 |
| DE | 4134452 | | 4/1993 |
| DE | 4215273 | | 11/1993 |
| DE | 4242530 | | 6/1994 |
| DE | 4011656 | | 1/1995 |
| DE | 4324137 | | 1/1995 |
| DE | 4107151 | | 2/1995 |
| DE | 29517128 | | 2/1996 |
| DE | 4242530 | | 9/1996 |
| DE | 3544845 | | 12/1996 |
| DE | 29710175 | | 9/1997 |
| DE | 19616510 | | 3/1998 |
| DE | 19651149 | | 6/1998 |
| DE | 19709641 | | 9/1998 |
| DE | 19718319 | | 11/1998 |
| DE | 19735189 | | 6/2000 |
| DE | 20001225 | | 8/2000 |
| DE | 19925248 | | 12/2000 |
| DE | 199225248 | | 12/2000 |
| DE | 20017461 | | 3/2001 |
| DE | 20018284 | | 3/2001 |
| DE | 1 0001585 | | 7/2001 |
| DE | 20206460 | | 8/2002 |
| DE | 101 60 316 | A1 | 6/2003 |
| DE | 20218331 | | 5/2004 |
| EP | 0248127 | | 12/1987 |
| EP | 0548758 | | 6/1993 |
| EP | 0623724 | | 11/1994 |
| EP | 0652340 | | 5/1995 |
| EP | 0667936 | | 8/1995 |
| EP | 0690185 | | 1/1996 |
| EP | 0849416 | | 6/1998 |
| EP | 0698162 | | 9/1998 |
| EP | 0903451 | | 3/1999 |
| EP | 0855482 | | 12/1999 |
| EP | 0877130 | | 1/2000 |
| EP | 0969163 | | 1/2000 |
| EP | 0969164 | | 1/2000 |
| EP | 0974713 | | 1/2000 |
| EP | 0843763 | | 10/2000 |
| EP | 1200690 | | 5/2002 |
| EP | 0958441 | | 7/2003 |
| EP | 1026341 | | 8/2003 |
| EP | 1413695 | | 4/2004 |
| ES | 163421 | | 9/1968 |
| ES | 460194 | | 5/1978 |
| ES | 283331 | | 5/1985 |
| ES | 1019585 | | 12/1991 |
| ES | 1019585 | | 1/1992 |
| ES | 2168045 | | 5/2002 |
| FI | 843060 | | 8/1984 |
| FR | 1293043 | | 4/1962 |
| FR | 2691491 | | 11/1983 |
| FR | 2568295 | | 5/1986 |
| FR | 2623544 | | 5/1989 |
| FR | 2630149 | | 10/1989 |
| FR | 2637932 | | 4/1990 |
| FR | 2675174 | | 10/1991 |
| FR | 2667639 | | 4/1992 |
| FR | 2691491 | | 11/1993 |
| FR | 2697275 | | 4/1994 |
| FR | 2712329 | | 5/1995 |
| FR | 2776956 | | 10/1999 |
| FR | 2781513 | | 1/2000 |
| FR | 2785633 | | 5/2000 |
| GB | 424057 | | 2/1935 |
| GB | 585205 | | 1/1947 |
| GB | 599793 | | 3/1948 |
| GB | 636423 | | 4/1950 |
| GB | 812671 | | 4/1959 |
| GB | 1033866 | | 6/1966 |
| GB | 1034117 | | 6/1966 |
| GB | 1044846 | | 10/1966 |
| GB | 1237744 | | 6/1968 |
| GB | 1127915 | | 9/1968 |
| GB | 1275511 | | 5/1972 |
| GB | 1399402 | | 7/1975 |
| GB | 1430423 | | 3/1976 |
| GB | 2117813 | | 10/1983 |
| GB | 2126106 | | 3/1984 |
| GB | 2152063 | | 7/1985 |
| GB | 2238660 | | 6/1991 |
| GB | 2243381 | | 10/1991 |
| GB | 2256023 | | 11/1992 |
| JP | 54-65528 | | 5/1979 |
| JP | 57-119056 | | 7/1982 |
| JP | 59-186336 | | 10/1984 |
| JP | 3-169967 | | 7/1991 |
| JP | 4-106264 | | 4/1992 |
| JP | 5-148984 | | 6/1993 |
| JP | 6-56310 | | 5/1994 |
| JP | 6-146553 | | 5/1994 |
| JP | 6-200611 | | 7/1994 |
| JP | 6-320510 | | 11/1994 |
| JP | 7-76923 | | 3/1995 |
| JP | 7-180333 | | 7/1995 |
| JP | 7-300979 | | 11/1995 |

| | | |
|---|---|---|
| JP | 7-310426 | 11/1995 |
| JP | 8-109734 | 4/1996 |
| JP | 8-270193 | 10/1996 |
| JP | 11 291203 | 10/1999 |
| NE | 7601773 | 2/1976 |
| NO | 157871 | 2/1988 |
| NO | 305614 | 6/1999 |
| SE | 7114900-9 | 9/1974 |
| SE | 450411 | 6/1987 |
| SE | 450141 | 9/1987 |
| SE | 501014 | 10/1994 |
| SE | 501914 | 6/1995 |
| SE | 502994 | 4/1996 |
| SE | 506254 | 11/1997 |
| SE | 509059 | 11/1998 |
| SE | 509060 | 11/1998 |
| SE | 512313 | 2/2000 |
| SE | 5122990 | 2/2000 |
| SE | 0000200-6 | 8/2001 |
| SU | 363795 | 12/1972 |
| WO | 84/02155 | 6/1984 |
| WO | 87/03839 | 7/1987 |
| WO | 89/08539 | 9/1989 |
| WO | 92/17657 | 10/1992 |
| WO | 93/13280 | 7/1993 |
| WO | 93/19910 | 10/1993 |
| WO | 94/01628 | 1/1994 |
| WO | 94/26999 | 11/1994 |
| WO | 95/06176 | 3/1995 |
| WO | 96/27719 | 9/1996 |
| WO | 96/27721 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 99/40273 | 8/1999 |
| WO | 99/66151 | 12/1999 |
| WO | 99/66152 | 12/1999 |
| WO | 00/06854 | 2/2000 |
| WO | 00/66856 | 11/2000 |
| WO | 01/66876 | 9/2001 |

OTHER PUBLICATIONS

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc.* et al. vs. *International Trade Commission and Pergs, Inc.* et al. decided Sep. 10, 2003.

German Federal Patent Court Proceeding regarding German Pat. No. DE 102 52 866, pronounced on Mar. 8, 2007, and English-language translation.

English language abstract of JP 11-290203.

Boehme, Christian: Die Bedeutung des Rohdichteprofils für MDF, Mobil Holzwerkstoff Symposium, Jun. 7, 1991, Bad Griesbach.

English language abstract of DE 10001585.

MDF—Mitteldichte Faserplatten, published 1996.

English language abstract of EP 0548758.

English language abstract of Austria 57133.

* cited by examiner

PANEL AND PROCESS FOR PRODUCING A PANEL

BACKGROUND OF THE INVENTION

1. Field of the Invention

The invention relates to a panel according to the preamble of claim 1 and to a process for producing a panel according to the preamble of claim 11. A support board for a panel and a process for producing such a support board also form part of the subject matter of the invention.

Such a panel or such a support board is suitable, in particular, for a floor panel.

2. Background Description

The support boards used in laminate flooring are usually HDF or MDF boards which have a stamped formation on the surface in order for it to be possible to achieve a decoration-following structure on the top side. The stamping process is carried out in parallel with a short-cycle coating operation, while a plurality of paper layers are pressed with one another and with a mat made of woodbased material, preferably fibers. The structure here is produced by pressing plates which have a negative structure. This process is expensive and is distinguished by pressing plates being subjected to high levels of wear.

SUMMARY OF THE INVENTION

The object of the invention is to provide a panel or a support board made of binders and fillers, and also a process for producing the same, by means of which surface-structured panels can be produced more quickly and cost-effectively.

This object is achieved according to the invention by a panel having the features of claim 1 and a support board and a process for producing the same according to claims 11 and 15, respectively. Advantageous configurations and developments of the invention are described in the subclaims.

The fact that the density on the top side of the support board differs from that on the underside facilitates the operation of stamping or structuring the support board on account of the lower strength, as a result of which the wear to which the stamping plates or other structuring tools are subjected is reduced. It is likewise possible for the structuring or stamping to take place more quickly, which overall results in quicker and more cost-effective production.

Designing the support board with a density of less than 700 kg/m$^3$, while at the same time having a gluing factor of greater than 10%, results in the support board having more or less plastic-like properties in respect of weight and strength, although the amount of material used, on account of the embedded woodbased materials, preferably fibers, is considerably lower.

A development provides that the support board has a density of between 400 kg/m$^3$ and 650 kg/m$^3$, this resulting in optimum strength in relation to the density and the amount of material used.

Urea-formaldehyde resins (UF resins) or melamin enhanced urea-formaldehyde resins (MUF) are advantageously used for gluing the woodbased materials or fibers of the support board. It is also possible to use isocyanates as the means for gluing the fibers in the support board, the invention providing isocyanates with gluing factors of less than 20%. On account of their high heat resistance, isocyanates also make it possible to realize higher gluing factors. It is likewise the case that the addition of isocyanates maintains the strength during heat-intensive coating of the support board since, if use is made exclusively of urea-formaldehyde resins, there is a tendency for the support board to undergo a loss in strength during coating.

For appropriate production of support boards, depending on loading and use purpose, it is provided that a mixture of isocyanates and UF or MUF resins is used as the means for gluing the woodbased materials or fibers and the support board.

A development of the invention provides that the support board has a non-uniform density distribution over the cross section from the top side to the underside, the cover layer located on the underside having a density in the region of 1000 kg/m$^3$, whereas the central layers in the cross section are compressed to 400 kg/m$^3$-600 kg/m$^3$. The top side has a lower density than the underside, but advantageously a greater density than in the center of the support board. The higher levels of compression on the top side and underside ensures a high resistance against vertical mechanical loading, as is necessary, for example, when used for floor panels. A panel with such a support board is provided on the top side and the underside in each case with a termination layer, which usually comprises a melamin impregnated decorative layer or counteracting layer, in order additionally to protect the support board against mechanical damage.

On account of the reduction in weight of the support boards of comparatively low relative density, the transportation costs are lowered and, furthermore, the support board achieves a hitherto unknown level of flexibility, which allows for specific profile configurations, in particular in the case of so-called click-in connections.

Furthermore, the increase in the gluing factor results in improved moisture resistance since the reduced proportion of woodbased materials in the boards reduces the inclination of the support board to swell up. The penetration of wetness into the region where two support boards or two floor panels are connected results in the support boards swelling up in this region and thus in the floor being destroyed. On account of the lesser tendency to swell up (below 5%), the support board according to the invention and a floor panel produced thereby are suitable, in particular, for use in wet rooms.

In addition, the layers of different densities within the support board result in a refraction of the sound waves at the density-transition locations, so that the footfall and room sound is markedly reduced.

The process for producing a panel, in particular a floor panel, in the case of which a support board is produced by the compression and heating of glued woodbased materials makes provision for the support board to be provided with a structured surface on a top side, and for a termination layer to be applied to the support board provided with the stamped formation. Setting different densities on the top side and the underside of the support board facilitates the stamping of the support board because the strength of the cover layer of the support board is lower on the top side than on the underside. The overall strength of the panel is only adversely affected to a slight extent since the underside has a very high density and strength and improved material values can be achieved on account of the high gluing proportions.

The single-sided reduction in the bulk density of the support board on the top side during the production process takes place either by virtue of the cover layer of the top side being ground off or by the single-sided application of good heat conductors, such as water, on the underside prior to the woodbased material being heated and compressed during the production of the support board. The supply of the heat-conducting media, for example by spraying the woodbased materials designed, for example as a fiber mat, results in the heat penetrating more quickly into the fiber mat. The adhesives are thus activated more quickly and enhanced compression takes place on one side of the fiber mat. On the opposite side, the degree of compression is correspondingly lower, with the result that this side can be used for easier surface stamping. This process maintains the fiber structure while, at the same time, having different densities on the top side and underside, which has an advantageous effect on the strength of the support board and of the panel.

As an alternative, or in addition, to the stamping operation, the structure of the support board may be produced by a grinding-off operation.

BRIEF DESCRIPTION OF THE DRAWINGS

The invention is explained in more detail hereinbelow with reference to the attached figures, in which.

DETAILED DESCRIPTION OF EMBODIMENTS OF THE INVENTION

Figure 1:
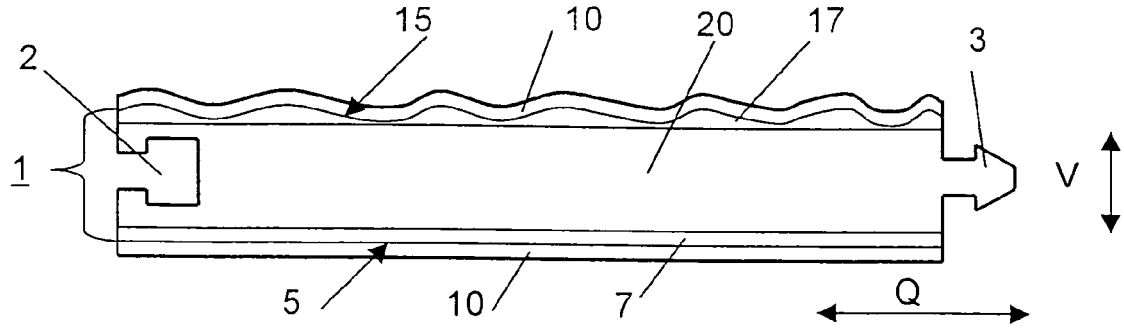
FIG. 1 shows a cross-sectional view of a panel.

FIG. 1 shows a cross section of a floor panel having a support board 1 with a termination layer 10 applied in each case to its top side 15 and underside 5. The termination layers 10 are applied, preferably glued, to the cover layers 7, 17, forming the outer termination of the support board 1, and protect the support board 1, for example, against moisture and mechanical loading. It is likewise possible for these termination layers 10 to have a decoration and to increase the mechanical stability of the floor panel.

Figure 2:
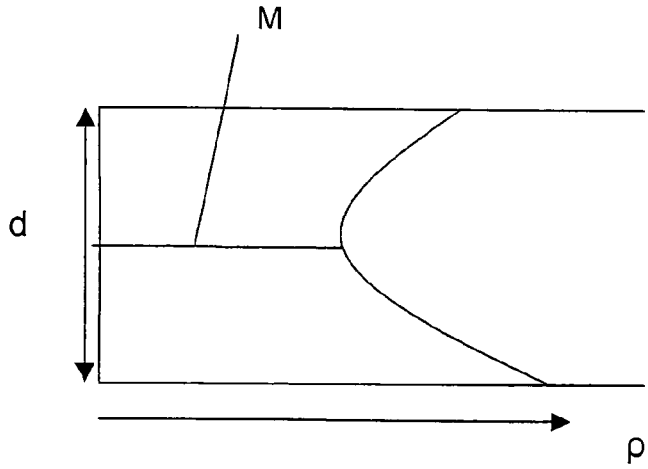
FIG. 2 shows a density distribution over the cross section of a support board.

Locking means 2, 3 are formed on the side edges of the panel, these locking means preventing two interconnected panels from moving relative to one another both in the vertical direction V and in the transverse direction Q. The support board 1 here is produced from a fiber material which is usually used for producing HDF boards; as an alternative, or in addition, other woodbased materials are incorporated. The cover layers 7, 17 of the support board 1 have a considerably higher density than the core 20 of the support board 1, densities of up to 1000 kg/m$^3$ being achieved in the cover layers 7 of the underside 5, while lower densities are set in the cover layer 17 of the top side 15. Within the core 20, the density decreases continuously toward the center M of the support board 1, a corresponding density distribution over the thickness d of a support board 1 being illustrated in FIG. 2. The latter shows that the lowest value for the density $\rho$ is achieved in the center M of the support board, while the density $\rho$ increases over the thickness d of the support board, starting from the center M, in order to reach its maximum on the surfaces of the cover layers 7, 17, the maximum value on the top side 15 being lower than the maximum value on the underside 5.

The extremely high density, in the region of 1000 kg/m$^3$, in the cover layer 7 of the underside 5 provides the support board 1 with the necessary resistance to vertical, mechanical loading, it being possible, in conjunction with the use of UF or MUF resins, if appropriate mixed with isocyanates, to produce a particular level of flexibility within the board. The addition of isocyanates improves the moisture resistance of the support board 1, with the result that the significant properties of the support board 1 are defined by the resins used and/or the plastics introduced.

FIG. 1, furthermore, shows the structured surface of the top side 15 and of the termination layer 10 applied thereto, it being possible for the structure to be provided by a stamping operation during coating with the termination layer 10. Since the density of the cover layer 17 on the top side 15 is lower than that on the underside 5, the stamping operation is rendered easier and the wear to which the stamping plates are subjected is reduced.

As an alternative to spraying the fiber mat with water, it is also possible for other heat-conducting media to be introduced specifically into the fibers, or applied to the fibers, in order to achieve an asymmetrical density distribution over the thickness of the support board. Liquids other than water may be used. It is likewise possible for an appropriate distribution of the woodbased materials or fibers to result in the mat which is to be pressed being such that the support board has an asymmetrical density distribution, for example by the top cover layer consisting of a material which cannot be compressed to such a high extent.

The invention claimed is:

1. A panel having a support board made of glued and compressed woodbased material to which a termination layer is applied in each case on a top side and an underside, and the termination layer of the top side has a structured surface, wherein the density on the top side of the support board is lower than the density of the support board on the underside.

2. The panel according to claim 1, wherein the support board has a density of less than 700 kg/m$^3$.

3. The panel according to claim 1, wherein a gluing factor of the support board is greater than 10%.

4. The panel according to claim 1, wherein UF resins or MUF resins are used as a means for gluing fibers of the support board.

5. The panel according to claim 1, wherein isocyanates are used as a means for gluing woodbased materials of the support board.

6. A panel having a support board made of glued and compressed fiber material to which a termination layer is applied in each case on a top side and an underside, and the termination layer of the top side has a structured surface, wherein the density on the top side of the support board is lower than the density of the support board on the underside, and isocyanates are used as a means for gluing woodbased materials of the support board, and further comprising a gluing factor of less than 20% for isocyanates.

7. The panel according to claim 1, further comprising a mixture of isocyanates and UF or MUF resins as a means for gluing woodbased materials of the support board.

8. The panel according to claim 1, wherein the support board has a non-uniform density distribution over its cross section from the top side to the underside.

9. The panel according to claim 8, wherein a density of 1000 kg/m$^3$ is present on the underside of the support board, while a density of from 400 kg/m$^3$ to 600 kg/m$^3$ is present in the center of the support board.

10. A process for producing a panel as recited in claim 1, comprising:

compressing and heating the glued fiber material to form the support board; and applying a stamped formation to the termination layer to provide the structured surface on the top side of the support board, wherein the density on the top side of the support board is set to be lower than the density of the support board on the underside.

11. A process for producing a panel, in particular floor panel, in the case of which a support board is produced by the compression and heating of glued woodbased materials, and the support board is provided with a structured surface on a top side, and a termination layer is applied to the support board provided with a stamped formation, characterized in that the density on the top side of the support board is set to be lower than the density of the support board on the underside.

12. The process according to claim 11, wherein the different densities are set by virtue of a cover layer of the top side being ground off.

13. The process according to claim 11, wherein the different densities are set by the single-sided application of heat-conducting media, in particular water, to the underside prior to the woodbased material being heated.

14. The process according to one of claim 11, wherein the structured surface is produced by a grinding-off and/or stamping operation.

15. A process for producing a support board made of glued and compressed woodbased fiber material for a panel, in particular floor panel, in a case of which a density on a top side of the support board is lower than a density of the support board on a underside, and in the case of which the fiber material is compressed with a supply of pressure and heat, wherein the density on the top side of the support board is set to be lower than a density of the support board on the underside by a single-sided application of water to the underside prior to the woodbased material being heated and compressed.

16. A panel, comprising:

a support board composed of glued, compressed woodbased material, having a top side and an underside;

a first termination layer provided on the top side;

a second termination layer provided on the underside, wherein the density of the support board continuously decreases from the top side to a substantial midpoint of the support board, and continuously decreases from the underside to the substantial midpoint.

17. The panel of claim 16, wherein the density at the top side is less than the density at the underside.

18. The panel of claim 16, wherein the first termination layer comprises a decoration.

19. The panel of claim 16, wherein the first termination layer comprises a structure composed of a stamping.

20. The panel of claim 16, wherein a density distribution through a thickness of the support board is substantially parabolic in shape.

21. The panel of claim 16, wherein the support board comprises cover layers and the first termination layer and second termination layer are glued to the cover layers.

* * * * *